US005954857A

United States Patent [19]

Rudloff

[11] Patent Number: 5,954,857

[45] Date of Patent: Sep. 21, 1999

[54] MOLYBDENUM OXIDE BRIQUETTES AND A PROCESS FOR THEIR PREPARATION

[75] Inventor: Frederick A. Rudloff, North Salt Lake, Utah

[73] Assignee: Kennecott Holdings Corporation, Magna, Utah

[21] Appl. No.: 08/873,042

[22] Filed: Jun. 11, 1997

Related U.S. Application Data

[63] Continuation-in-part of application No. 08/785,351, Jan. 17, 1997, abandoned.

[51] Int. Cl.[6] ..... C22C 29/00

[52] U.S. Cl. ..... 75/326; 75/313; 75/303; 75/228

[58] Field of Search ..... 75/326, 313, 303, 75/228

[56] References Cited

U.S. PATENT DOCUMENTS

| | | | |
|---|---|---|---|
| 2,398,114 | 4/1946 | Rennie | 75/84 |
| 3,865,573 | 2/1975 | Neumann et al. | 75/3 |
| 3,942,974 | 3/1976 | Moreau et al. | 75/3 |
| 3,966,459 | 6/1976 | Buker | 75/84 |
| 4,045,216 | 8/1977 | Meyer et al. | 75/84 |
| 4,147,539 | 4/1979 | Kekish | 75/257 |
| 4,160,661 | 7/1979 | Brigham et al. | 75/12 |
| 4,360,615 | 11/1982 | Wang et al. | 524/9 |
| 4,362,559 | 12/1982 | Perez et al. | 75/53 |
| 4,369,062 | 1/1983 | Strange | 75/256 |
| 4,400,207 | 8/1983 | Tanson | 75/129 |
| 4,828,729 | 5/1989 | Centers | 252/25 |
| 5,395,441 | 3/1995 | Bogdan et al. | 106/714 |

*Primary Examiner*—Patrick Ryan
*Assistant Examiner*—M. Alexandra Elve
*Attorney, Agent, or Firm*—Whyte Hirschboeck Dudek

[57] ABSTRACT

Briquettes of either technical or chemical grade molybdenum oxide and a binding material selected from the group consisting of (a) sodium hydroxide, and (b) a binding composition comprising (i) at least one of ammonium and an alkali metal hydroxide, and (ii) an inert filler that has a $d_{80}$ particle size at least about the same $d_{80}$ particle size of the molybdenum oxide exhibit excellent resistance to breakage and dusting.

8 Claims, No Drawings

MOLYBDENUM OXIDE BRIQUETTES AND A PROCESS FOR THEIR PREPARATION

This application is a continuation in part of application Ser. No. 08/785,351, filed on Jan. 17, 1997, abandoned.

BACKGROUND OF THE INVENTION

This invention relates to molybdenum oxide briquettes. In one aspect, the invention relates to briquettes comprising molybdenum oxide (also known as "moly oxide") and a binder and in one embodiment, an inert filler, while in another aspect, the invention relates to molybdenum oxide briquettes in which the binder is an alkali metal hydroxide such as sodium hydroxide (NaOH) in combination with an inert filler such as a silica (e.g. a diatomaceous earth) or an alumina (e.g. an activated or fused alumina). In yet another aspect, the invention relates to a process for making a briquette comprising molybdenum oxide and a binder, optionally with an inert filler.

Molybdenum is a well known and extensively used alloying agent for producing stainless and other speciality steels. However, molybdenum is not found in nature as a free element and as such, it must be separated from the other elements with which it is associated in its natural state before it is useful as an alloying agent. Conventionally, this is accomplished by subjecting the molybdenum-containing ore to a series of beneficiation steps to produce molybdenite ($MoS_2$) which is then converted to molybdenum oxide, i.e. a material containing mostly molybdenum trioxide ($MoO_3$) with minor amounts of molybdenum dioxide ($MoO_2$), molybdenum sesquioxide ($Mo_2O_3$), other oxides of molybdenum, the oxides of other elements such as copper, iron, arsenic, etc., and gangue material (the latter two of which were either present in the molybdenum-containing ore or were acquired during the beneficiation process). The moly oxide is then typically compacted into a briquette which is suitable for use as an alloying agent, e.g. as a feed to a metallurgical melt in which it is converted to metallic molybdenum.

Briquettes are a preferred form of moly oxide for various reasons not the least of which is ease of handling and minimized dusting, the latter of which is not only hygienically and environmentally undesirable but also represents a potential loss of material. The conventional process for making moly oxide briquettes is well known, and it comprises blending in any conventional manner moly oxide with a binding material (comprising either a binder alone or a binder in combination with one or more other substances, e.g. fillers) to form a substantially uniform mixture which is then fed to any standard briquetting apparatus. The briquettes as produced by the apparatus are uncured (i.e. "green"), but they are typically cured (either under atmospheric or oven conditions) to some extent before packaging and shipment to a customer.

Important physical properties of a briquette are its resistance to breakage and dusting. From almost the moment a briquette is formed, it is subjected to both crushing and abrasive forces from contact with the briquetting equipment; curing, storing and packaging equipment; packaging material and, of course, other briquettes.

The resistance of a briquette to breakage and dusting is a function of many factors not the least of which is the nature and amount of binding material used to make the briquette. The binding material is selected not only for its ability to form and hold the moly oxide in a briquette shape, but also for its cost and ease of separation from the moly oxide in the metallurgical melt. Low cost is important because the binding material is sacrificial, i.e., it is not recovered for reuse, and ease and thoroughness of separation are important because binding material residue in most circumstances is considered an impurity in the steel.

Known binders include ammonium hydroxide solution, starches, gelatins, sugars, molasses, tall oil pitch and sodium silicates, and known fillers include wood flour, sulfur and phenolic resins in the form of microballoons. One important characteristic of an acceptable filler is the ability to readily vaporize under melt conditions.

While all of these binding materials are effective to one degree or another, none are completely satisfactory for any of various reasons. In particular, a continuing interest exists in identifying new binding materials that exhibit an ability to bind effectively into briquettes moly oxide of a very fine average particle size, e.g. less than 50 microns.

SUMMARY OF THE INVENTION

According to this invention, a molybdenum oxide briquette resistant to breakage and dusting comprises molybdenum oxide and a binding material selected from the group consisting of (a) sodium hydroxide, and (b) a binding composition comprising (i) at least one of ammonium and an alkali metal hydroxide, and (ii) an inert filler that has a similar or greater $d_{80}$ particle size than the $d_{80}$ particle size of the molybdenum oxide. The briquette is prepared by a process comprising the steps of:

A. blending the molybdenum oxide and the binding material to form a mixture in which the binding material is substantially uniformly dispersed throughout the molybdenum oxide, and B. forming briquettes from the mixture.

The moly oxide is of technical or chemical grade, and the briquettes are formed on any conventional briquetting equipment. Optionally and preferably, the briquettes are cured either under atmospheric or oven conditions.

DETAILED DESCRIPTION OF THE INVENTION

The molybdenum oxide used in the practice of this invention is either of technical or chemical grade. Technical grade moly oxide typically contains between about 85 and 96, preferably between about 90 and 96 and more preferably between about 94 and 96, weight percent molybdenum trioxide (with the remainder molybdenum dioxide, molybdenum sesquioxide, other oxides of molybdenum, the oxides of other elements and gangue material (the latter two of which were either present in the molybdenum-containing ore or were acquired during the beneficiation process)). For purposes of this invention, moly oxide containing more than 96 weight percent molybdenum trioxide is termed chemical grade moly oxide although as a practical matter, chemical grade moly oxide typically contains at least about 99, preferably at least about 99.5 and more preferably at least about 99.9, weight percent molybdenum trioxide with the remainder various impurities which were acquired during the process by which the chemical grade moly oxide was produced.

The technical grade moly oxide used in the practice of this invention is sized such that at least about 90 percent of it passes through a 60 U.S. Standard mesh screen (which means that the size of the particle passing through the screen is less than about 250 microns), and at least about 50 percent of it passes through a 170 U.S. Standard mesh screen (which means that the size of the particle passing through the screen is less than about 90 microns). The chemical grade moly oxide used in the practice of this invention is sized such that at least about 90 percent of it passes through a 325 U.S. Standard mesh screen (which means that the size of the particle passing through the screen is less than about 45 microns), and at least about 50 percent of it is less than about 20 microns (for which a U.S. Standard mesh screen is not available). Generally, the purer (i.e. the more molybdenum trioxide) the moly oxide, the finer is its the particle size and the finer its particle size, the more difficult is it to briquette (as measured in terms of breakage and dusting resistance).

Typically, the moly oxide comprises at least about 85, preferably at least about 88 and more preferably at least about 90, weight percent of an uncured, i.e. green, briquette.

The binding material used in the practice of this invention is selected from the group consisting of (a) sodium hydroxide, and (b) a binding composition comprising (i) at least one of ammonium and an alkali metal hydroxide, and (ii) an inert filler that has an average particle size greater than the average particle size of the moly oxide. In those embodiments in which sodium hydroxide is the binding material, typically an aqueous solution of the sodium hydroxide is prepared and mixed with the moly oxide such that the mixture (and thus the green briquette) contains at least about 0.5, preferably at least about 1 and more preferably at least about 2, weight percent sodium hydroxide, with a maximum amount of sodium hydroxide of about 5 or less, preferably of about 4 or less and more preferably of about 3 or less, weight percent. The minimum water content of this mixture (and thus the water content of the green briquette) is at least about 2, preferably at least about 3 and more preferably at least about 4, weight percent with a maximum water content typically of about 8 or less, preferably of about 7 or less and more preferably about 6 or less, weight percent. Aqueous solutions of about 20 to about 40, preferably between about 25 and about 35, weight percent are representative of the aqueous solutions of sodium hydroxide used in the practice of this embodiment.

In those embodiments in which the binding material is a binding composition comprising (i) at least one of ammonium and an alkali metal hydroxide, and (ii) an inert filler that has a similar or greater average particle size greater than the average particle size of the moly oxide, the ammonium or alkali metal hydroxide, like the sodium hydroxide described above, is typically used as an aqueous solution. The ammonium or alkali metal hydroxide is prepared and mixed with the moly oxide and/or inert filler such that the mixture, i.e. moly oxide, binder and inert filler, (and thus the green briquette) contains at least about 0.5, preferably at least about 1 and more preferably at least about 2, weight percent ammonium or alkali metal hydroxide, with a maximum amount of such hydroxide of about 5 or less, preferably of about 4 or less and more preferably of about 3 or less, weight percent. The minimum water content of this mixture (and thus the water content of the green briquette) is at least about 2, preferably at least about 3 and more preferably at least about 4, weight percent with a maximum water content typically of about 8 or less, preferably of about 7 or less and more preferably of about 6 or less, weight percent. Aqueous solutions of about 20 to about 40, preferably between about 25 and about 35, weight percent are representative of the aqueous solutions of ammonium and/or alkali metal hydroxide used in the practice of this embodiment.

The ammonium and alkali metal (e.g. sodium, potassium, etc.) hydroxides are well known, readily available commodity compounds. The ammonium and sodium hydroxides are preferred for reasons of cost and availability. However, these compounds can be prepared in situ by blending a precursor with the moly oxide, e.g. blending ammonia ($NH_3$) with water and the moly oxide to form the ammonium hydroxide in situ.

The inert filler of this embodiment of the invention is preferably a silica or an alumina (aluminum silicates are not preferred because they tend to absorb water and swell) with a similar or greater $d_{80}$ particle size than the $d_{80}$ particle size of the moly oxide. As here used, "inert" means that the filler is essentially nonreactive with the moly oxide and the ammonium and/or alkali metal hydroxide under briquetting, curing, storage and use conditions, and "$d_{80}$ particle size" means that 80% of the particles in a sample are smaller than a stated size (in microns), or in "passing" terminology, 80% of the particles will pass through a screen of stated size (usually U.S. Standard, Tyler, etc.). For example, if a given sample of moly oxide has a $d_{80}$ of 45 microns, this means that 80% of the particles in that sample are 45 microns or less in size, or in passing terminology, 80% of the particles in that sample will pass through a 325 U.S. Standard mesh screen. If a filler has a $d_{80}$ of 90 microns, then 80% of the particles in the filler sample are 90 microns or less in size, in passing terminology, or 80% of the particles in this sample will pass through a 170 U.S. Standard mesh screen. The $d_{80}$ particle size of the filler is typically at least about the same as, preferably at least about 100% greater and more preferably at least about 150% greater, than the $d_{80}$ particle size of the moly oxide.

Representative silicas include diatomaceous earth (also known as Kieselguhr or diatomite and occasionally here referred to as simply "earth"), silica sand, and silica flux; and representative aluminas include activated and fused alumina. The silicas are the preferred fillers, and those comprising at least about 75, preferably at least about 80 and more preferably at least about 85, weight percent silica are most preferred.

In those embodiments in which the binder is a combination of ammonium hydroxide and an inert filler, the ammonium hydroxide is typically formed in situ by adding to a mixture of moly oxide and inert filler at least about 0.2, preferably at least about 0.5 and more preferably at least about 0.8, weight percent ammonia, and at least about 2, preferably at least about 3 and more preferably at least about 4, weight percent water, each based on the combined weight of the moly oxide, filler, ammonia and water. The maximum amount of ammonia added to the mixture of moly oxide and filler is typically of about 1.8 or less, preferably about 1.5 or less and more preferably of about 1.2 or less, weight percent with the maximum amount of water added to this mixture typically of about 8 or less, preferably of about 7 or less and more preferably of about 6 or less, weight percent, again each based on the combined weight of the moly oxide, filler, ammonia and water.

The minimum amount of inert filler used to form the mixture of moly oxide, filler, ammonia and water, based on the weight of this mixture, is typically at least about 2, preferably at least about 3 and more preferably at least about 4, weight percent with the maximum amount typically of about 10 or less, preferably of about 8 or less and more preferably of about 6 or less, weight percent. The inert filler is typically used in its commercially available form, e.g. as a powder.

Although the moly oxide and inert filler are usually first blended with one another followed by the addition of the ammonia and/or alkali metal hydroxide precursor and water (in either order, or simultaneously, or as a previously prepared solution of ammonium and/or alkali metal hydroxide), other orders of addition can be employed. For example, ammonia and water can first be blended with the filler and then this mixture combined with the moly oxide, or ammonia and water can first be blended with the moly oxide and then this mixture combined with the filler, or ammonia can be blended with the filler and water with the moly oxide before combining the two mixtures, or vice versa.

As here used, "briquette" means a molded product of any size and shape formed by compacting together particulate, usually finely divided, material. Typically, the briquette is pillow-shaped with dimensions of about 1.5 by about 1 by about 0.75 inches. The briquettes of this invention are made using known equipment and known procedures. For example, the moly oxide is blended with the binding material in any conventional blending apparatus, e.g. a pug mill. The mixture is blended until the binding material is substantially uniformly dispersed throughout the moly oxide, and then the mixture (which usually has a paste-like consistency) is transferred to any standard briquetting device for conversion into briquettes. Typically the mixture is added to a feed hopper from which it is transferred by any conventional means, e.g. a screw, to the role nip at which it is compacted into briquettes.

Briquettes as produced by the briquetting device are uncured or green, and uncured briquettes are typically less resistant to breakage and dusting than cured briquettes. However, green briquettes should have sufficient strength to resist breakage and dusting from their contact with the briquetting, transfer and storage equipment and other briquettes until cured (or at least partially cured). Since the moly oxide and filler (if used) are essentially dry or water-free at the time of their use to prepare the feed to the briquetting device, these uncured briquettes typically contain only that water which was used in the preparation of the feed mixture, e.g. between about 2 and about 10 weight percent.

As a practical matter, briquettes usually demonstrate greater resistance to breakage and dusting after cure than before cure. Curing is effected in any number of ways the most typical of which are oven drying at an elevated temperature (e.g. 100–200 C.), or simply by drying under ambient conditions (with or without exposure to forced air). The briquettes are then transferred to packaging in which they are typically readied for shipment in sealed pails or bags (although the briquettes are occasionally shipped in bulk, i.e. unpackaged, form).

The briquettes of this invention are used in the same manner as known moly oxide briquettes. They are prepared for and added to metallurgical melts in the same quantity and manner as known briquettes, and they disperse and are consumed within these melts in the same manner as known briquettes.

The following examples are illustrative embodiments of this invention. Unless otherwise indicated, all parts and percentages are by weight.

EXAMPLES

All the briquettes of these examples were made with chemical grade moly oxide, 99.9 percent by weight molybdenum trioxide with a particle size distribution as follows:

| Microns | % Passing |
|---|---|
| 5–10 | 10 |
| 10–16 | 50 |
| 25–50 | 80 |
| 35–70 | 90 |

The briquettes labeled A, B and C are outside of the scope of this invention, and are provided for comparative purposes. Briquettes A were made in the same manner as briquettes D–G (all of which are within the scope of this invention), and both briquettes B and C are available commercially and each is made with technical grade moly oxide (87–94 wt % molybdenum trioxide) and an ammonium hydroxide binder but not in combination with an inert filler. Briquettes B were air cured.

Briquettes A were made from a mixture containing 95.24 wt % moly oxide, 3.9 wt % water and 0.86 wt % ammonia (the water and ammonia were added separately to the moly oxide). Briquettes D were made from a mixture containing 90.47 wt % moly oxide, 4.8 wt % diatomaceous earth (F-1), 3.9 wt % water and 0.86 wt % ammonia (the moly oxide and earth were first blended with one another, and then the water and ammonia were added separately to this mixture). The size analysis of F-1 was as follows:

| Microns | % Passing |
|---|---|
| 149 | 91.9 |
| 74 | 88.4 |
| 44 | 80.6 |
| 37 | 77.0 |

Briquettes E were made from a mixture containing 100 kg moly oxide and 10 kg caustic solution (33 wt % NaOH).

Briquettes F were made from a mixture containing 95 kg moly oxide, 5 kg diatomaceous earth (F-2), and 10 kg caustic solution (33 wt % NaOH). The size analysis of F-2 was as follows:

| Microns | % Passing |
|---|---|
| 177 | 86 |
| 105 | 77 |
| 74 | 70 |
| 44 | 60 |

Briquettes G were made from a mixture containing 95 kg moly oxide, 5 kg crushed silica (F-3), and 10 kg caustic solution (33 wt % NaOH). The size analysis of F-3 was as follows:

| Microns | % Passing |
|---|---|
| 250 | 97.1 |
| 149 | 49.8 |
| 105 | 29.0 |
| 74 | 17.5 |
| 44 | 7.1 |

All of the mixtures were made in a pug mill operated at ambient temperature and pressure and once all the mixture components were in the mill, it was operated for a total time of 7 minutes.

The K. R. Komarek model B-100QC roll press was used to make all of the briquettes of these examples. The substantially homogeneous mixtures made in the pug mill were transferred to the feed hopper of the roll press. The mixtures were then transferred by way of a screw from the feed hopper to the roll nip at which briquettes of 1.625×0.875×0.5 inches in size were prepared. The briquettes subjected to the strength tests were those produced by the roll press after it was operating under stable conditions (which are described in Table I).

Two properties of briquette strength were measured. The first, crush strength, was determined by placing a briquette between two parallel steel plates, and then hydraulically imparting to one of the plates a force until the briquette failed (i.e. cracked). Briquette crush strength is expressed as the maximum force the briquette resisted before failing, and it is reported in Table II.

The second measure of briquette strength, drop strength, was determined by two similar but different tests. The first measure of drop strength was determined by dropping a sample of briquettes onto a concrete floor, the drop strength defined by the height of the drop when more than 50% of the sample began to break because of the force of the impact between the briquettes and the floor (i.e. the "height" drop strength). The results of this test are also reported in Table II.

TABLE I

Roll Press Operating Conditions and Briquette Weight

| | Briquette | | | | |
|---|---|---|---|---|---|
| Operating Condition | A ($NH_4OH$ only) | D ($NH_4OH$ + F-1) | E (NaOH) | F (NaOH + F-2) | G (NaOH + F-3) |
| Mixture Bulk Density ($g/cm^3$) | 1.13 | 1.05 | 1.72 | 1.48 | 1.81 |
| Roll Diameter (mm) | 130 | 130 | 130 | 130 | 130 |
| Roll Face Width (mm) | 51 | 51 | 51 | 51 | 51 |
| Roll Speed (rev/min) | 3.2 | 3.2 | 3.8 | 3.8 | 3.8 |
| Initial Roll Gap (mm) | 0.7 | 0.7 | 0.7 | 0.7 | 0.7 |
| Briquette Calculated Pressure (Mpa) | 27.65 | 27.65 | 30.25 | 30.25 | 30.25 |
| Measured Throughput (tons/hr) | 0.117 | 0.123 | 0.134 | 0.131 | 0.149 |
| Briquette Weight (g) | 28.71 | 28.91 | 28.62 | 27.10 | 30.36 |

TABLE II

Briquette Crush Strength and Height Drop Strength

| | A | D | E | F | G |
|---|---|---|---|---|---|
| BRIQUETTE WEIGHT (g) | 28.24 | 28.96 | 28.62 | 27.36 | 30.36 |
| BRIQUETTE VOLUME ($cm^3$) | 7.95 | 8.47 | NM | 8.42 | NM |
| BRIQUETTE DENSITY ($g/cm^3$) | 3.55 | 3.42 | NM | 3.25 | NM |
| MEAN CRUSH FORCE (GREEN) (N) | 127.5 | 215.7 | 327.4 | 394.9 | 411.4 |
| DROP HEIGHT AT FAILURE (GREEN) (m) | 0.9 | 1.5 | NM | NM | NM |
| MEAN CRUSH FORCE (AFTER 1 HOUR AT 150° C.) (N) | 2702.6 | 3258.6 | 3251.5 | 2590.9 | 2510.9 |
| MEAN CRUSH FORCE (AFTER 120 HOURS AT AMBIENT TEMPERATURE) (N) | 1050.6 | 951.8 | 1089.8 | 1979.9 | 1434.5 |

NM = Not Measured.

The data of Table II shows that the D and E briquettes are markedly superior in crush force after curing for 1 hour at 150 C. and the F and G briquettes are markedly superior in crush force after curing for 120 hours at ambient conditions than the A briquettes (i.e. those with a binding material of only ammonium hydroxide). Moreover, all the briquettes of this invention were markedly stronger in terms of mean crush strength while "green" than the A briquettes.

The second measure of drop strength was determined by first subjecting the briquettes to screening to remove fines, and then taking an approximately 1 kg sample of those briquettes that did not pass through a 3 U.S. Standard mesh screen (which means that each briquette in the sample was at least about 0.75 inches in each dimension) and passing this sample through a 6 foot, 12 inch inner diameter tube which had one open end resting on a 0.5 inch thick steel plate (the "tube" drop strength). The sample was collected, dropped through the tube again, then collected again and screened. The screenings were then combined, passed through the tube twice again (in the same manner as the first two passes), collected and screened. The results are reported in Table III.

TABLE III

Briquette Tube Drop Strength

| Briquette | Cure | Wt % Passing Through Screen After 4 Drops | | | |
|---|---|---|---|---|---|
| | | 3 Mesh[3] | 8 Mesh[4] | 20 Mesh[5] | 48 Mesh[6] |
| A | Air[1] | 6.3 | 4.1 | 2.5 | 1.3 |
| A | Oven[2] | 7.3 | 4.9 | 2.9 | 1.5 |
| B | Unknown | 4.5 | 2.6 | 1.8 | 1.1 |
| C | Unknown | 10.8 | 5.8 | 3.7 | 2.6 |
| D | Air[1] | 2.4 | 1.4 | 0.8 | 0.4 |
| D | Oven[2] | 3.5 | 2.7 | 1.3 | 0.7 |
| B | Air[1] | 3.2 | 1.9 | NM | NM |
| E | Oven[2] | 4.0 | 2.2 | NM | NM |
| F | Air | 1.0 | 0.6 | NM | NM |
| F | Oven | 1.4 | 1.0 | NM | NM |
| G | Air | 1.5 | 1.1 | NM | NM |
| G | Oven | 2.1 | 1.4 | NM | NM |

[1]120 hours at ambient temperature.
[2]21 hour at 150° C.
[3]About 6700 microns.
[4]About 2380 microns.
[5]About 841 microns.
[6]About 297 microns.
NM = Not Measured.

The data of Table III is of particular interest in that the tube drop strength test is more representative of the handling a briquette will experience at a steel making operation than is the height drop strength test. In the typical steel operation in which moly oxide briquettes are used as an alloying agent, the material handling systems used to transport the briquettes from the delivery vehicle to the storage bin and from the storage bin to the melt usually consists of a series of conveyors onto and from which the briquettes are repeatedly dropped from various heights. As such, dusting (i.e. the creation of fines from the briquettes) is as an important measure of briquette strength as is actual breakage.

The data of Table III shows that the briquettes of this invention (i.e. those labeled D–G) exhibit superior tube drop strength to not only the A briquettes, but also to those commercially available briquettes labeled B and C. The amount of fines passing through all four mesh sizes was almost always less than half (and in many circumstances much less than half) for the D–G briquettes than for the A, B and C briquettes regardless of whether the briquettes were air or oven cured. This is particularly notable with respect to briquettes B and C since these were made of technical grade moly oxide which is coarser (i.e. of larger $d_{80}$ particle size) than that of chemical grade moly oxide. Generally, the smaller the $d_{80}$ particle size of a moly oxide, the more difficult to compact it into a strong briquette (all else being the same). This is especially true for moly oxide in which most of the particles are less than 50 microns in size.

Although the invention has been described in considerable detail, this detail is for the purpose of illustration only. Many variations and modifications can be made on the invention as described above without departing from the spirit and scope of the invention as described in the appended claims.

What is claimed is:

1. A briquette comprising (A) molybdenum oxide present in an amount of at least about 85 wt % based on the weight of the briquette, and (B) a binding material present in an amount of at least about 0.5 wt % based on the weight of the briquette, the binding material selected from the group consisting of (a) sodium hydroxide, and (b) a composition of (i) at least one of ammonium and an alkali metal hydroxide, and (ii) an insert filler that has a $d_{80}$ particle size at least about the same as the $d_{80}$ particle size of the molybdenum oxide.

2. The briquette of claim 1 in which the molybdenum oxide is technical grade molybdenum oxide.

3. The briquette of claim 1 in which the molybdenum oxide is chemical grade molybdenum oxide.

4. The briquette of claim 1 in which the binding material is sodium hydroxide.

5. The briquette of claim 1 in which the binding material is a binding composition comprising (i) at least one alkali metal hydroxide, and (ii) an inert filler selected from the group consisting of silicas and aluminas.

6. The briquette of claim 5 in which the alkali metal hydroxide is sodium hydroxide.

7. The briquette of claim 6 in which the inert filler is a silica.

8. The briquette of claim 7 in which the sodium hydroxide is present in an amount of at least 0.2 weight percent based upon the weight of the briquette.

* * * * *

UNITED STATES PATENT AND TRADEMARK OFFICE

CERTIFICATE OF CORRECTION

PATENT NO. : 5,954,857

DATED : September 21, 1999

INVENTOR(S) : Federick A. Rudloff

It is certified that error appears in the above-identified patent and that said Letters Patent is hereby corrected as shown below:

Column 9, line 35: Replace "B" with --E--.

Signed and Sealed this

Twenty-ninth Day of February, 2000

*Attest:*

Q. TODD DICKINSON

*Attesting Officer*

*Commissioner of Patents and Trademarks*